US005862566A

United States Patent [19]

Balger

[11] Patent Number: 5,862,566

[45] Date of Patent: Jan. 26, 1999

[54] MOP HEAD ATTACHMENT MECHANISM

[76] Inventor: Eileen Balger, 414 Ipswich Rd., Boxford, Mass. 01921

[21] Appl. No.: 867,221

[22] Filed: Jun. 2, 1997

[51] Int. Cl.[6] ..... A47L 13/14; A47L 13/20

[52] U.S. Cl. ..... 15/228; 15/119.1; 15/119.2; 15/244.1

[58] Field of Search ..... 15/228, 229.4, 15/229.8, 231, 232, 244.1, 244.2, 244.3, 119.1, 119.2

[56] References Cited

U.S. PATENT DOCUMENTS 2,764,774 10/1956 Belsky ..... 15/228
3,909,870 10/1975 Leland ..... 15/244.2
5,596,787 1/1997 Stevens ..... 15/228
5,740,578 4/1998 Moore ..... 15/231

*Primary Examiner*—Randall E. Chin
*Attorney, Agent, or Firm*—Frederick R. Cantor, Esq.

[57] ABSTRACT

A mop head assembly includes an absorbent pad cleaning element releasably attached to a rigid head element by an attachment sheet permanently bonded to the upper surface of the pad element. The attachment sheet has a coating of a water-resistant contact adhesive for establishing a releasable connection between the pad element and the rigid head element. In preferred practice of the invention the attachment sheet has adhesive edge tabs that extend around peripheral edge areas of the rigid head element.

13 Claims, 4 Drawing Sheets

MOP HEAD ATTACHMENT MECHANISM

BACKGROUND OF THE PRESENT INVENTION

SUMMARY OF THE PRESENT INVENTION

This invention relates to a mop head assembly, and particularly to a mechanism for attaching a floor engageable cleaning member to a rigid head element carried by a mop handle. The invention is especially concerned with the attachment mechanism.

The conventional mop assembly comprises a rigid head element located at the lower end of an elongated handle, and a replaceable cleaning element attachable to the rigid head element by means of two or more screw-nut assemblies. Usually the cleaning element comprises a deformable porous sponge member having a rigid backing plate or sheet. The attachment screws extend between the backing plate and the rigid head element.

One problem with the use of attachment screws is that such screws can loosen as the mop head assembly is moved back and forth over the floor surface. Another difficulty is that the attachment force is concentrated at the screws; load forces shift back and forth at an angle to the screw axes so that the connections between the screws and the sponge backing plate can, over time, weaken or fail.

The present invention relates to a mop head assembly having an adhesive connection between the head element and the replaceable pad-type cleaning element. The adhesive connection is designed to avoid problems associated with the screw type connections used in the prior art. Also, the cleaning pad assembly can be a low cost disposable structure readily replaceable on a mop head after a single usage, so as to achieve a high degree of sanitation not possible with reusable constructions.

In one preferred form of the invention, the mop head assembly comprises a rigid head element having a flat lower surface and a cleaning element pad having a flexible attachment sheet permanently affixed to its upper surface. The attachment sheet has a coating of a contact adhesive thereon, whereby the cleaning element pad can be releasably attached to the lower surface of the rigid head element.

The adhesively-coated attachment sheet has edge tabs that can be extended upwardly along the peripheral edge of the rigid mop head element and onto the upper surface of said head element. The edge tabs enhance the adhesive attachment action of the attachment sheet. When it becomes necessary or desirable to remove the cleaning element pad from the rigid mop head element the attachment sheet can be torn or peeled away from the head element without undue effort. A new replacement cleaning element pad can be adhesively attached to the rigid head element quickly and easily.

Specific features and advantages of the invention will be apparent from the attached drawings and description of an illustrative embodiment of the invention.

In summary, and in accordance with the above discussion, the foregoing objectives are achieved in the following embodiments.

1. A mop head assembly comprising:

a rigid head element having a flat lower surface, a peripheral edge, and an upper surface;

a floor treatment pad having a flat upper surface; and an attachment sheet permanently affixed to the pad upper surface;

said attachment sheet having edge tabs adapted to extend upwardly along at least the peripheral edge of said head element; and said attachment sheet and the associated tabs having a coating of contact adhesive thereon adapted to be adhesively attached to at least the lower surface and peripheral edge of the rigid head element.

2. The mop head assembly, as described in paragraph 1, wherein there are six tabs spaced around said pad.

3. The mop head assembly, as described in paragraph 1, wherein each said tab has a length that enables the tab to extend upwardly beyond the peripheral edge of said head element and onto the upper surface of said head element.

4. The mop head assembly, as described in paragraph 1, wherein said head element has a rectangular plan configuration defined by two longitudinal edges and two end edges; and said tabs comprising at least two tabs adapted to extend upwardly along each longitudinal edge of said head element.

5. The mop head assembly, as described in paragraph 4, wherein each tab has a length that enables the tab to extend an appreciable distance along the upper surface of said head element.

6. The mop head assembly, as described in paragraph 1, wherein said pad has a rigid backing sheet permanently affixed to said attachment sheet.

7. The mop head assembly, as described in paragraph 1, wherein said pad has its upper surface directly affixed to said attachment sheet.

8. The mop head assembly, as described in paragraph 1, wherein said attachment sheet is formed of a plastic material.

9. The mop head assembly, as described in paragraph 1, wherein said attachment sheet is formed of a relatively thin plastic sheet adapted to form a crease, whereby said plastic sheet is enabled to conform to an edge surface of the head element that is normal to the head element lower surface.

10. The mop head assembly, as described in paragraph 1, wherein said attachment sheet is formed of a relatively thin sheet material having the ability to conform to angularly related surfaces without forming gaps at the juncture between such surfaces, whereby the attachment sheet tabs are enabled to readily bend around corners formed between the edge of said head element and the adjoining head element surfaces.

11. A mop head assembly comprising:

a rigid head element having a rectangular plan configuration defined by two longitudinal edges and two end edges;

said head element having a flat lower surface spanning said longitudinal edges and said end edges;

a floor treatment pad having the same plan configuration as said head element;

said pad having a flat upper surface adapted to register with the lower surface of said head element;

and an attachment sheet permanently affixed to the pad upper surface;

said attachment sheet having two edge tabs adapted to extend upwardly along each longitudinal edge of the head element onto the head element upper surface, and a single edge tab adapted to extend upwardly along each end edge of the head element onto the head element upper surface; and said attachment sheet and the associated tabs having a coating of contact adhesive thereon adapted to be adhesively attached to engaged surfaces on the rigid head element.

12. The mop head assembly, as described in paragraph 11, wherein said pad has a rigid backing sheet permanently affixed to said attachment sheet.

13. The mop head assembly, as described in paragraph 12, wherein the upper surface of said pad is directly affixed to said attachment sheet.

14. A mop head assembly comprising:

a head element connectable to a handle, and a floor engageable member releasably attachable to said head element;

said floor engageable member having a flexible attachment sheet adapted to partially wrap around said head element; and said attachment sheet having a coating of contact adhesive thereon engageable with the head element.

BRIEF DESCRIPTION OF THE DRAWINGS

FIG. 8 shows the mop head in its use position. FIG. 9 shows the mop head folded for squeezing liquid out of the sponge cleaning elements.

DESCRIPTION OF THE PREFERRED EMBODIMENTS OF THE PRESENT INVENTION

Figure 1:
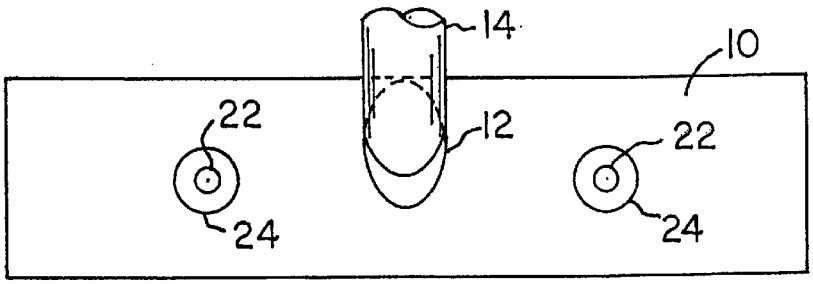
FIG. 1 PRIOR ART
FIG. 1, is a top plan view, of a mop head assembly representative of the prior art.

FIG. 1, is a top plan view, of a mop head assembly representative of the prior art.

Figure 2:
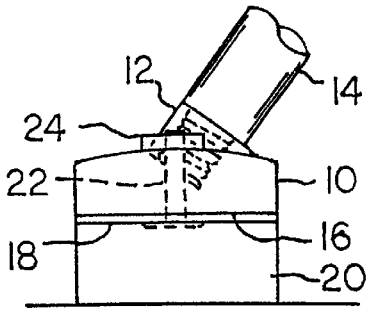
FIG. 2 PRIOR ART
FIG. 2, is a right end view, of the FIG. 1 mop head assembly.

FIG. 2, is a right end view, of the FIG. 1 mop head assembly.

Referring to FIGS. 1 and 2, there is shown a prior art mop head assembly that comprises a rigid head element 10 having an internally threaded socket 12 for receiving the threaded end of an elongated handle 14. The rigid head element 10 has a lower surface 16 that is releasably engageable with a backing plate (or sheet) 18 that is permanently affixed to a sponge cleaning element 20.

Backing sheet 18 and sponge element 20 form a replaceable cleaning element that can be removed and replaced, as necessary. The mop head assembly can be used for various floor treatment operations, e.g. washing, squeegee water removal, or waxing.

The prior art cleaning element is releasably attached to rigid head element 10 by means of two screws 22 located equidistant from socket 12. Each screw has its lower end attached to backing sheet 18; in some cases the backing sheet has slots that fit onto the heads of the screws. Each screw extends upwardly through a hole or passage in head element 10 so as to protrude above the upper surface of the head element; a nut 24 is hand-tightened on the screw to secure the cleaning element to head element 10.

In an alternate prior art arrangement (not shown) each nut is anchored or embedded in the backing plate. Each screw is threaded downwardly through a hole in the head element 10 so as to thread into the embedded nut; the head of the screw exerts a clamp force on the upper surface of head element 10.

With either prior art arrangement there is a tendency for the screw to rotate or separate from the sponge backing sheet. As the sponge cleaning element is moved repetitively back and forth along the floor surface the sponge material is alternately compressed and extended (or stretched) so as to apply a cyclic load force on backing sheet 18. The sheet tends to alternately pull away from the two screws 22 or exert a pressure force on the screws, depending on whether the sponge material is expanding or compressing.

One or both screws can, over time, become disconnected from backing sheet 18 so as to rotate or rattle. The cleaning element can thus wobble or vibrate so as to lose its functional effectiveness. The present invention is concerned with a mop head assembly wherein the cleaning element pad is securely attached to the rigid head element, while at the same time being detachable from the head element when it becomes necessary to replace a worn cleaning element with a new cleaning element. The pad type cleaning element can be a disposable assembly useable on a one-time basis, or a durable pad construction usable repetitively until worn out.

Figure 3:
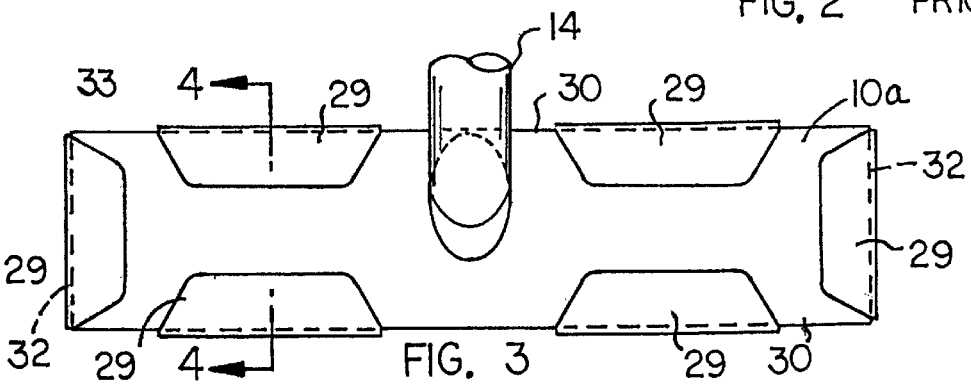
FIG. 3, is a top plan view, taken in the same direction as FIG. 1, but showing a mop head assembly constructed according to the present invention.

FIG. 3, is a top plan view, taken in the same direction as FIG. 1, but showing a mop head assembly constructed according to the present invention.

Figure 4:
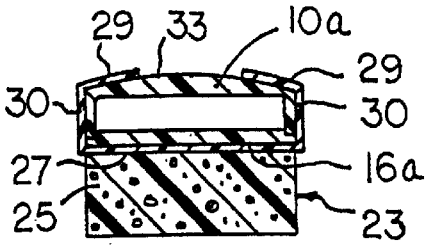
FIG. 4, is a transverse cross-sectional view, taken on line 4—4 in FIG. 3.

FIG. 4, is a transverse cross-sectional view, taken on line 4—4 in FIG. 3.

As shown in FIGS. 3 and 4, the invention is embodied in a mop head assembly that includes a rigid head element 10*a* that may be constructed similarly to the head element shown in FIG. 1, except for the absence of the screw holes (passages). Head element 10*a* has a lower flat surface 16*a* that is adapted to have flatwise releasable engagement with a sponge floor treatment (or cleaning) pad assembly 23.

Figure 7:
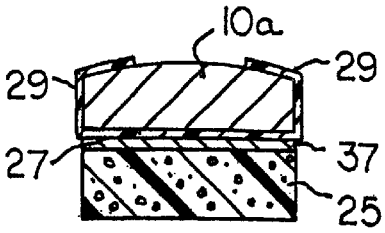
FIG. 7, is a sectional view, taken in the same direction as FIG. 4, but illustrating another embodiment of the invention.
Figure 10:
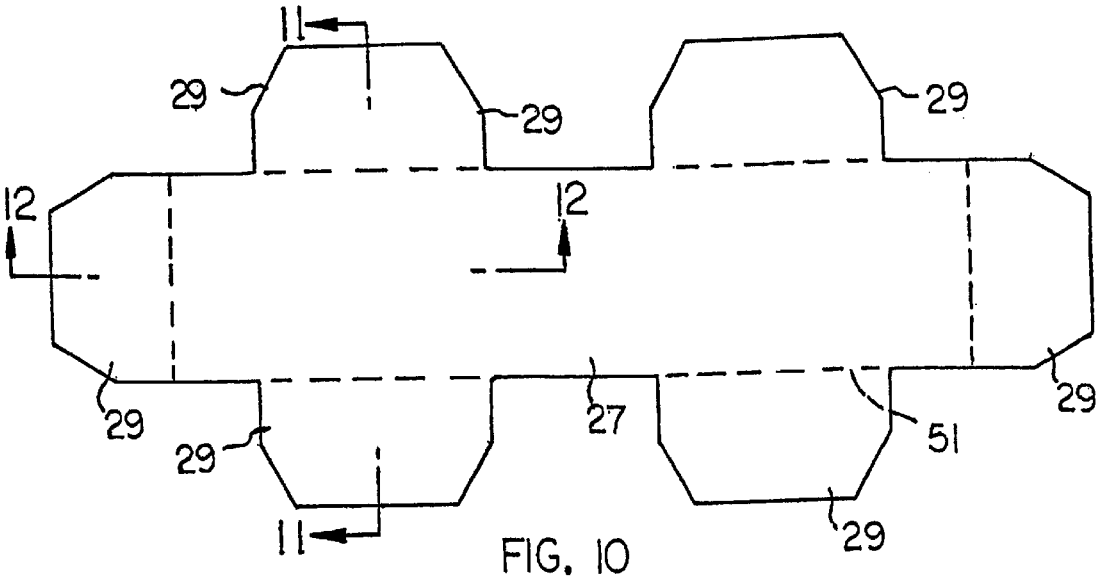
FIG. 10, shows an alternate cleaning pad that can be used in practice of the invention.
Figure 11:
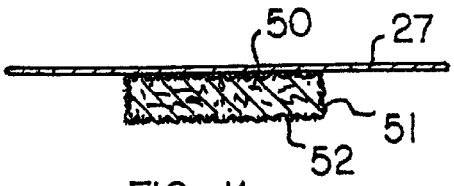
FIGS. 11 and 12, are sectional views, taken respectively on lines 11—11 and 12—12 in FIG. 10.
Figure 12:
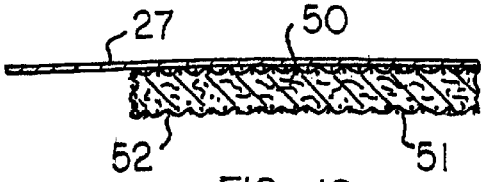

As shown in FIGS. 3, 4 and 7, the cleaning pad is a sponge. However, other absorbent pad materials can be used. For example, as shown in FIGS. 10 through 12, the cleaning pad comprises a rectangular core of absorbent cotton batting encased within a porous cloth covering. As shown in FIGS. 1 through 4, the cleaning assembly 23 comprises a rectangular pad-type sponge 25 and an attachment sheet 27 permanently secured together, e.g. by means of a waterproof bonding agent. Sheet 27 has six edge tabs 29 adapted to extend upwardly along longitudinal edge areas 30 and end edges 32 of the rigid head element 10*a*. Each tab is of sufficient length as to extend onto the upper surface 33 of the head element.

The upper surfaces of sheet 27, and the associated tabs 29, are coated with a water-resistant contact adhesive, such that when the sponge assembly 23 is applied to the lower surface of head element 10*a* an adhesive connection is established between the cleaning element and the head element.

The attachment sheet 27 has an extensive surface area, so that the cyclic stretching-pulling forces exerted by the sponge cleaning element are effectively absorbed. Unit area load forces are relatively low. Adhesive edge tabs 29 provide anchorages on the upper surface of head element 10*a* that are subjected to relatively slight stress, since load stresses are fully absorbed by the adhesive connections between sheet 27 and the head element surface 16*a*. Tabs 29 serve primarily as insurance against separation of sheet 27 and head element surface 16*a*.

FIGS. 3 and 4 show the attachment sheet 27 as having six edge tabs 29. However, a lesser number of tabs can be used. For example, the attachment sheet can have four tabs arranged at, or near, the corner areas of the sheet. The tabs can terminate below the upper surface of head element 10*a*. However, in preferred practice of the invention the tabs are made long enough as to extend onto upper surface 33 of the head element 10*a*, as depicted in FIG. 3.

Attachment sheet 27 can be formed of various sheet materials having the necessary flexibility that will enable the integral tabs to extend around the corners formed by the peripheral edges 30 and 32 of head element 10*a*. The sheet material can be plastic or elastomeric (woven or non-woven). The sheet material should have the ability to form a crease at each corner of the head element edge 30 or 32, so that the sheet material will be essentially free of internal stresses that would tend to cause bent areas of the sheet to pull away from the head element surface.

Figure 5:
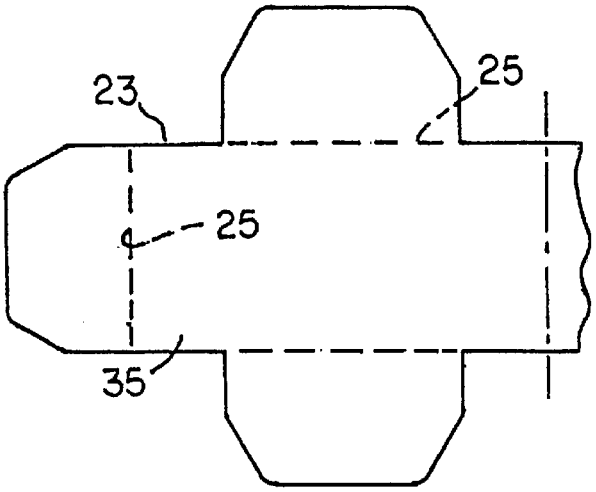
FIG. 5, is a fragmentary plan view, of a replaceable sponge cleaning element used in the FIG. 3 mop head assembly. The sponge cleaning element is shown with its attachment sheet in an unfolded condition prior to connection with the rigid head element.

FIG. 5, is a fragmentary plan view, of a replaceable sponge cleaning element used in the FIG. 3 mop head assembly. The sponge cleaning element is shown with its attachment sheet in an unfolded condition prior to connection with the rigid head element.

Figure 6:
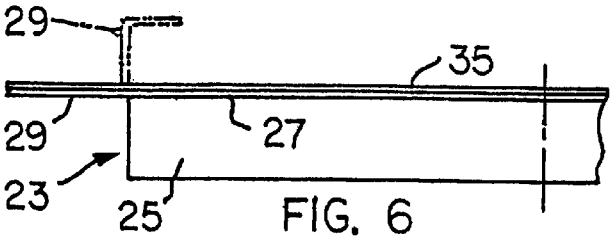
FIG. 6, is an edge view, of the sponge cleaning element shown fragmentarily in FIG. 5.

FIG. 6, is an edge view, of the sponge cleaning element shown fragmentarily in FIG. 5.

FIGS. 5 and 6 fragmentarily show the cleaning element assembly 23 detached from the rigid head element 10*a*. For packaging and handling purposes the cleaning assembly is provided with a disposable cover sheet 35 on the otherwise exposed adhesive surface of attachment sheet 27. Cover sheet 35 has the same shape as attachment sheet 27, with some optional overlap beyond the edges of sheet 27 to ensure complete coverage. The surface of cover sheet 35 in contact with attachment sheet 27 has a wax-like release coating to facilitate separation of the cover sheet from the cleaning assembly 23 when the cleaning assembly is to be attached to the mop head element 10*a*.

FIG. 7, is a sectional view, taken in the same direction as FIG. 4, but illustrating another embodiment of the invention.

In preferred practice of the invention the attachment sheet 27 is directly bonded to pad 25, as shown in FIG. 4. However, if desired a stiffener (backing) sheet 37 can be provided between the pad and attachment sheet 27, as shown in FIG. 7. The backing sheet acts as a stiffener to ensure that the contact adhesive surface of attachment sheet 27 is flat when the cleaning element is initially placed against the lower surface of head element 10*a*.

Figure 8:
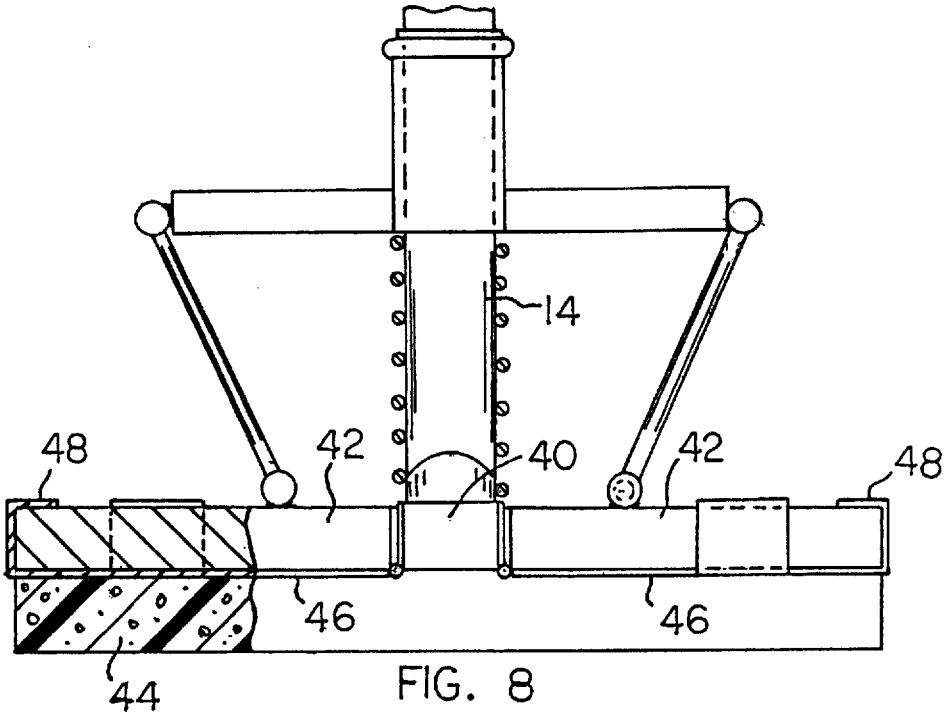
FIGS. 8 and 9, are front elevational views, of a foldable mop head assembly embodying the invention.
Figure 9:
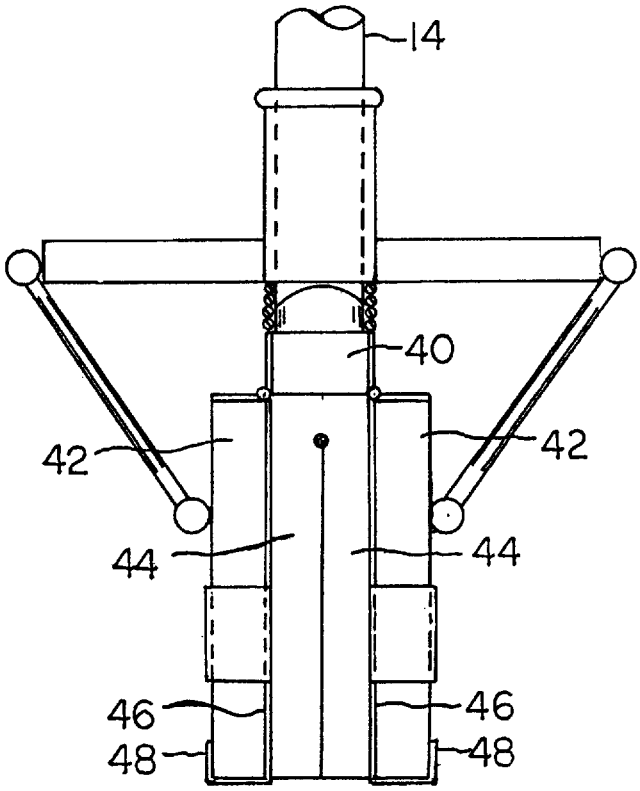

FIGS. 8 and 9, are front elevational views, of a foldable mop head assembly embodying the invention. FIG. 8 shows the mop head in its use position. FIG. 9 shows the mop head folded for squeezing liquid out of the sponge cleaning elements.

FIGS. 8 and 9 show the invention applied to a mop head assembly of the foldable type. In this arrangement the rigid head element comprises a central head section 40 and two hinged side sections 42. The foldable sponge cleaning element comprises a sponge-type pad 44 attached to the head section 42 by two separate attachment sheets 46. Each attachment sheet has its upper surface coated with a contact adhesive for releasable attachment to the associated head section 42. Each attachment sheet has edge tabs 29 adapted to extend around the peripheral edges of an associated head section 42.

It will be seen that the invention can be applied to various types of mops and mop head assemblies.

FIG. 10, shows an alternate cleaning pad that can be used in practice of the invention.

FIGS. 11 and 12, are sectional views, taken respectively on lines 11—11 and 12—12 in FIG. 10.

FIGS. 10 through 12 show an alternate form that the cleaning pad can take. In this case, the pad 51 comprises compressed cotton batting core 50 encased in a porous woven covering sheet 52. Preferably the covering sheet completely envelopes the cotton batting core. The covering sheet can be an elongated preformed tubular structure adapted to be filled with compressed cotton batting, e.g. by blowing the cotton fibers into the tubular structure, to achieve an absorbent pad construction. The pad can be formed by procedures used to manufacture womens' sanitary napkins. The aim is to achieve a low cost disposable pad having good liquid absorbing capabilities.

Absorbent pad 51 is permanently affixed to an attachment sheet 27 that can be constructed similarly to the attachment sheet 27 depicted in FIGS. 4 and 6. As shown in FIG. 10, the attachment sheet has multiple edge tabs 29 adapted to partially encircle edge areas of a mop head, in the previously described fashion.

The upper surface of attachment sheet 27 (FIGS. 11 and 12) is coated with a contact adhesive, whereby the cleaning pad assembly can be readily attached to the lower surface of a mop head (not shown). The cleaning pad assembly of FIGS. 10 through 12 can be reusable or it can be a disposable item usable on a one-time basis, as necessary or desired. Replacement of the cleaning pad assembly is easily accomplished.

The present invention, described above, relates to a mop head attachment mechanism. Features of the present invention are recited in the appended claims. The drawings contained herein necessarily depict structural features and embodiments of the mop head attachment mechanism, useful in the practice of the present invention.

However, it will be appreciated by those skilled in the arts pertaining thereto, that the present invention can be practiced in various alternate forms, proportions, and configurations. Further, the previous detailed descriptions of the preferred embodiments of the present invention are presented for purposes of clarity of understanding only, and no unnecessary limitations should be implied therefrom. Finally, all appropriate mechanical and functional equivalents to the above, which may be obvious to those skilled in the arts pertaining thereto, are considered to be encompassed within the claims of the present invention.

What is claimed:

1. A mop head assembly comprising:

a rigid head element having a flat lower surface, a peripheral edge, and an upper surface;

a floor treatment pad having a flat upper surface; and an attachment sheet permanently affixed to the pad upper surface;

said attachment sheet having edge tabs adapted to extend upwardly along at least the peripheral edge of said head element; and said attachment sheet and the associated tabs having a coating of contact adhesive thereon adapted to be adhesively attached to at least the lower surface and peripheral edge of the rigid head element.

2. The mop head assembly, as described in claim 1, wherein there are six tabs spaced around said pad.

3. The mop head assembly, as described in claim 1, wherein each said tab has a length that enables the tab to extend upwardly beyond the peripheral edge of said head element and onto the upper surface of said head element.

4. The mop head assembly, as described in claim 1, wherein said head element has a rectangular plan configuration defined by two longitudinal edges and two end edges; and said tabs comprising at least two tabs adapted to extend upwardly along each longitudinal edge of said head element.

5. The mop head assembly, as described in claim 4, wherein each tab has a length that enables the tab to extend an appreciable distance along the upper surface of said head element.

6. The mop head assembly, as described in claim 1, wherein said pad has a rigid backing sheet permanently affixed to said attachment sheet.

7. The mop head assembly, as described in claim 1, wherein said pad has its upper surface directly affixed to said attachment sheet.

8. The mop head assembly, as described in claim 1, wherein said attachment sheet is formed of a plastic material.

9. The mop head assembly, as described in claim 1, wherein said attachment sheet is formed of a relatively thin plastic sheet adapted to form a crease, whereby said plastic sheet is enabled to conform to an edge surface of the head element that is normal to the head element lower surface.

10. The mop head assembly, as described in claim 1, wherein said attachment sheet is formed of a relatively thin sheet material having the ability to conform to angularly related surfaces without forming gaps at the juncture between such surfaces, whereby the attachment sheet tabs are enabled to readily bend around corners formed between the edge of said head element and the adjoining head element surfaces.

11. A mop head assembly comprising:

a rigid head element having a rectangular plan configuration defined by two longitudinal edges and two end edges;

said head element having a flat lower surface spanning said longitudinal edges and said end edges;

a floor treatment pad having the same plan configuration as said head element;

said pad having a flat upper surface adapted to register with the lower surface of said head element;

and an attachment sheet permanently affixed to the pad upper surface;

said attachment sheet having two edge tabs adapted to extend upwardly along each longitudinal edge of the head element onto the head element upper surface, and a single edge tab adapted to extend upwardly along each end edge of the head element onto the head element upper surface; and said attachment sheet and the associated tabs having a coating of contact adhesive thereon adapted to be adhesively attached to engaged surfaces on the rigid head element.

12. The mop head assembly, as described in claim 11, wherein said pad has a rigid backing sheet permanently affixed to said attachment sheet.

13. The mop head assembly, as described in claim 12, wherein the upper surface of said pad is directly affixed to said attachment sheet.

* * * * *